US006679187B2

(12) United States Patent
Dorian et al.

(10) Patent No.: US 6,679,187 B2
(45) Date of Patent: Jan. 20, 2004

(54) SLAB AND COIL RAILCAR

(75) Inventors: Robert H. Dorian, Johnstown, PA (US); Todd L. Lydic, Johnstown, PA (US)

(73) Assignee: JAC Patent Company, Johnstown, PA (US)

( * ) Notice: Subject to any disclaimer, the term of this patent is extended or adjusted under 35 U.S.C. 154(b) by 0 days.

(21) Appl. No.: 10/044,815

(22) Filed: Jan. 9, 2002

(65) Prior Publication Data

US 2002/0152924 A1 Oct. 24, 2002

Related U.S. Application Data

(60) Provisional application No. 60/260,443, filed on Jan. 9, 2001.

(51) Int. Cl.[7] ..... B61D 17/00

(52) U.S. Cl. ..... 105/404

(58) Field of Search ..... 105/355, 359, 105/416, 417, 413, 418, 419, 420, 421, 409, 404, 422; 410/49, 47, 54, 98

(56) References Cited

U.S. PATENT DOCUMENTS

| | | | | | |
|---|---|---|---|---|---|
| 76,292 | A | * | 3/1868 | Al-Kaabi et al. | 126/31 |
| 2,810,602 | A | * | 10/1957 | Abrams | 410/42 |
| 2,977,900 | A | | 3/1961 | Farrar | 105/377 |
| 3,009,426 | A | | 11/1961 | Nampa | 105/367 |
| 3,186,357 | A | | 6/1965 | Fillion | 105/367 |
| 3,291,072 | A | | 12/1966 | Cunningham | 105/367 |
| 3,693,554 | A | * | 9/1972 | O'Leary et al. | 410/122 |
| 3,818,843 | A | * | 6/1974 | Lee | 410/68 |
| 4,451,188 | A | | 5/1984 | Smith et al. | 410/42 |
| 4,841,876 | A | | 6/1989 | Gramse et al. | 405/406.1 |
| 4,944,232 | A | * | 7/1990 | Schlaeger | 105/355 |
| 5,170,717 | A | | 12/1992 | Richmond et al. | 105/377 |
| 6,077,005 | A | | 6/2000 | Westlake | 410/49 |

FOREIGN PATENT DOCUMENTS

| | | | | |
|---|---|---|---|---|
| GB | 2052416 A | * | 1/1981 | B61D/3/16 |

* cited by examiner

*Primary Examiner*—S. Joseph Morano
*Assistant Examiner*—Frantz F. Jules
(74) *Attorney, Agent, or Firm*—Blynn L. Shideler; Krisanne Shideler; BLK Law Group

(57) ABSTRACT

A 100–125 ton capacity steel flat railcar hauls steel slabs with the capacity to alternatively haul steel coils. The car design allows steel slabs of various sizes and weights to be hauled efficiently by placing the slabs longitudinally on the car. The slabs are captive by side stanchions restricting the slabs from lateral movement and bulkheads at the ends preventing longitudinal movement of the slabs. The weight of the slabs is concentrated near the bolsters through raised mounting platforms. The railcar also has the capability to haul steel coils in a built-in trough over the bolster area. The end bulkheads restrict and position the steel coils allowing the coils in each trough to have a gap between them for ease of loading and unloading. The side stanchions restrict the steel coils from unwanted unloading due to coupler forces.

10 Claims, 10 Drawing Sheets

SLAB AND COIL RAILCAR

CROSS-REFERENCE TO RELATED APPLICATION

This application claims the benefit of U.S. Provisional Patent Application Serial No. 60/260,443, filed Jan. 9, 2001 entitled "Slab and Coil Railcar", which is incorporated herein by reference.

BACKGROUND OF THE INVENTION

1. Field of the Invention

The present invention relates to railcars for carrying slabs of various materials. More particularly, the present invention relates to a railcar for carrying steel slabs as well as steel coils. Most particularly, the present invention relates to a railcar for carrying steel slabs having an increased carrying capacity, easier loading and unloading, and having steel coil carrying capabilities.

2. Description of the Prior Art

Presently, steel slabs are often shipped on 52'-6" Mill Gondola cars. The loading and unloading of the steel slabs from the Mill Gondola cars is not as sufficiently efficient as it might be. Large, heavy, cylindrical objects, and particularly coils of rolled steel, are also commonly transported on a flatcar or a troughed car. Either type of car has a cargo bed supported on a center sill or similar structure running the length of the car. The individual coils are chained or otherwise restrained in place. With regard to railcars designed specifically for carrying coils, the prior art is somewhat voluminous.

Known railcar arrangements for hauling coils of various materials are disclosed, for example, in U.S. Pat. Nos. 2,977,900; 3,009,426; 3,186,357; 3,291,072; 4,451,188; and 6,077,005.

U.S. Pat. No. 2,997,900 shows a railcar for transporting steel coils. A cover is used on a gondola car with cradles formed in the bottom of the car to retain the steel coils. The body of the gondola-car includes a narrow platform along the outer edge of the car.

U.S. Pat. No. 3,291,072 discloses a support system for carrying different sized coils. The outer support members are fixed at a downward slope. The two inner support members are hinged at both ends so that they can be inverted to divide a single large storage position into two smaller storage positions.

U.S. Pat. No. 3,186,357 shows a side sill and top flange arrangement. Planks extend the length of the car and extend at a downward angle from the side sills to a center sill. This forms a cradle that is an integral part of the car structure.

U.S. Pat. No. 3,009,426 shows a railcar for transporting steel coils that include a hinged cover to enclose the steel coils. Wooden planks run the length of the cradle and are bolted to angled members. The wooden planks define the surface of the trough, which engages the steel coil. The cover is split down the middle and is hinged at the outer edges. The cover rotates to permit coils to be loaded from the top or from the ends of the enclosure.

U.S. Pat. No. 4,451,188 shows a support deck with trough assemblies mounted on the support deck. The trough assemblies have a configuration that facilitates the mounting of various coil sizes. Moveable troughs can be used to change the configuration of the decking for different coil arrangements.

When the coils are carried with their axes longitudinal to the direction of the car, the coils can move longitudinally in the bed due to acceleration, deceleration, or yard impacts. The interior turns of the coils can also extend or telescope axially out of the coils responsive to the same forces. (In relation to steel coils, "telescope" here means that the inner coils extend out of line with the outer coils. Respecting the sections of a cover, "telescope" means that the covers are shifted to an overlapping relation.) To alleviate these types of longitudinal movement, the prior art has placed transverse bars forward and aft of each coil. However, the weight of a steel coil is so great that the coil or its inner turns may shift longitudinally against the transverse bar. The steel is soft enough that the bar can be impressed on the exposed edges of the coil and even embedded in the coil, preventing the coil from being lifted vertically out of the car. Such engagement of the steel coil with the transverse bar damages or even ruins the metal of the coil.

This problem is discussed in U.S. Pat. No. 3,291,072. Cylindrical objects, such as steel coils, have also been carried transversely in troughs. Each trough has facing, inwardly inclined surfaces that support the coil. The transverse orientation of the coil prevents the inner turns from telescoping and centers the coil on the trough, preventing both forms of shifting. A disadvantage of such troughs is that some or all of the troughs and coils are supported above the center sill or similar structure for handling draft and buff loads. A flatcar does not allow the coils or troughs to project below the center sill of the car.

Well cars which have no center sill, and which transmit longitudinal loads from the couplers and draft sills through side sills, top chords, and other longitudinal members beside or beneath the cargo bed, are known. One example of such well car construction is U.S. Pat. No. 4,841,876. Additionally, U.S. Pat. No. 5,170,717 discloses a well-type car for transporting coils.

SUMMARY OF THE INVENTION

The slab car according to the present invention is a 100–125 ton capacity steel flat car for hauling steel slabs with the capacity for hauling steel coils. The car design allows steel slabs of various sizes and weights to be hauled efficiently by placing the slabs longitudinally on the car. The slabs are captive by side stanchions restricting the slabs from lateral movement and bulkheads at the ends preventing longitudinal movement of the slabs. The weight of the slabs is concentrated near the bolsters through raised mounting platforms. The railcar also has the capability to haul steel coils in a built-in trough over the bolster area. The end bulkhead restricts and positions the steel coils allowing the coils in each trough to have an 8" gap between them for ease of loading and unloading. One end of the car has a built-in cross over platform. The slab side stanchions double as steel coil stanchions restricting the steel coils from unwanted unloading due to coupler forces. The slab car of the present invention provides increased hauling capacity over prior art slab cars with less lineal track space. The loading and unloading of the car is improved over the prior art slab railcars. The ability to alternatively carry steel coils increases the flexibility of the railcar. Finally, the railcar can be easily arranged to specifically suit a specific size of steel slab as well as the diameter and width of steel coil.

A further slab car according to the present invention is a 100 ton flat railcar designed to haul steel slabs. The railcar is designed for 286,000 pound gross rail load. The railcar can accommodate steel slabs between 35" to 72" in width and lengths up to 44'.

The advantages of the railcars of the present invention will be clarified in the description of the preferred embodiments together with the figures.

DESCRIPTION OF THE PREFERRED EMBODIMENTS

Figure 1:
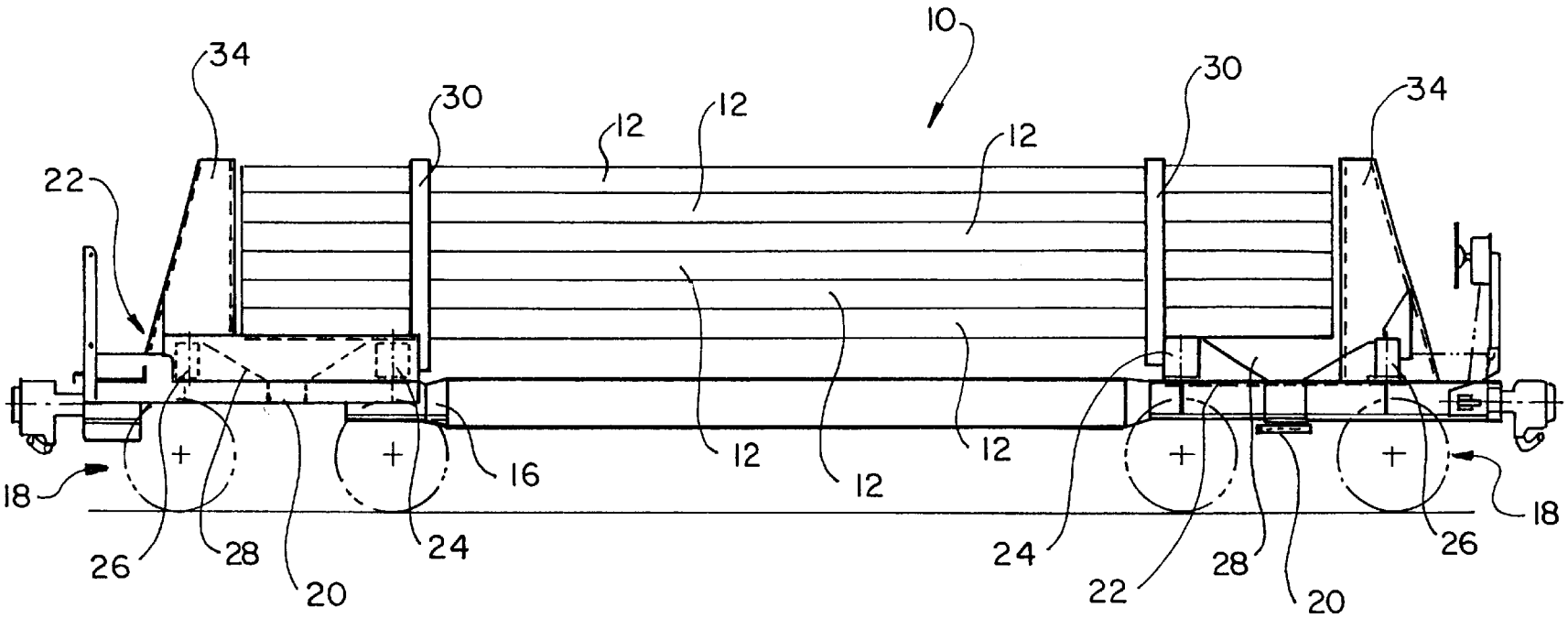
FIG. 1 is a side elevational view of a steel slab loaded railcar according to the present invention.
Figure 2:
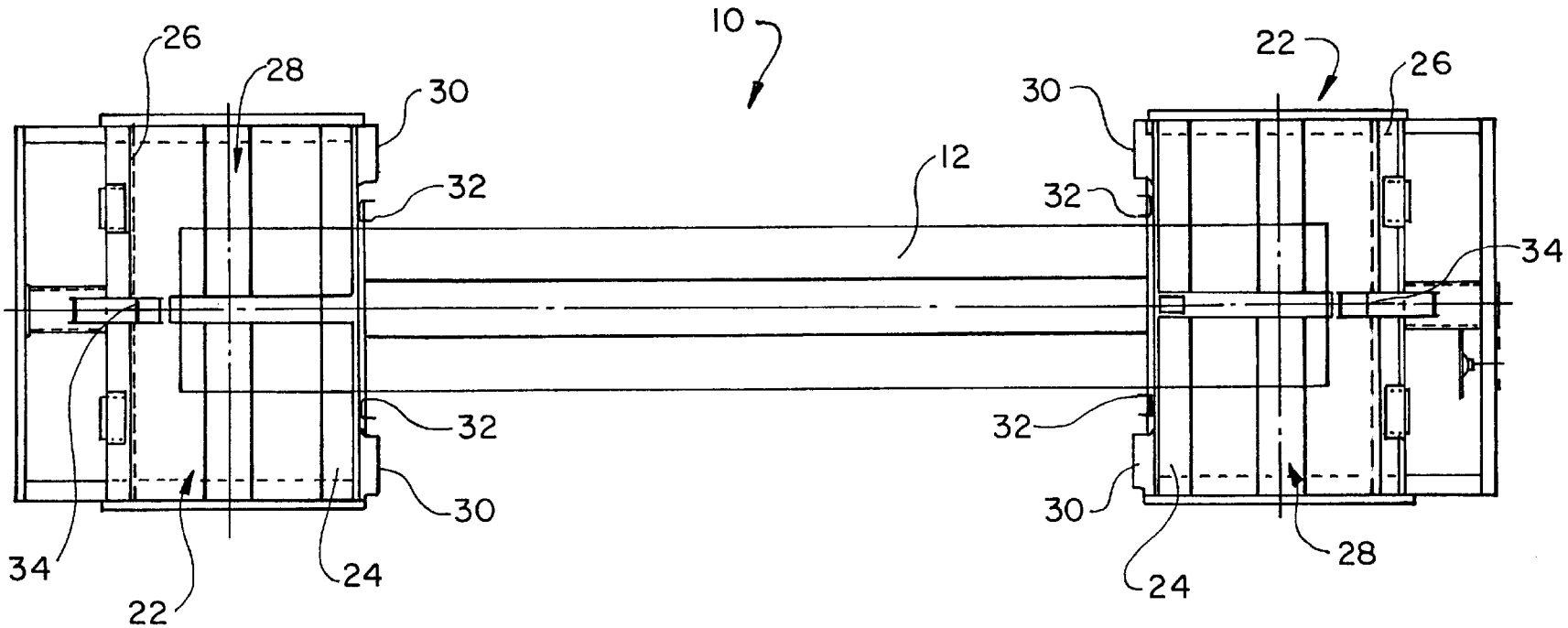
FIG. 2 is a plan view of the railcar of FIG. 1.
Figure 3:
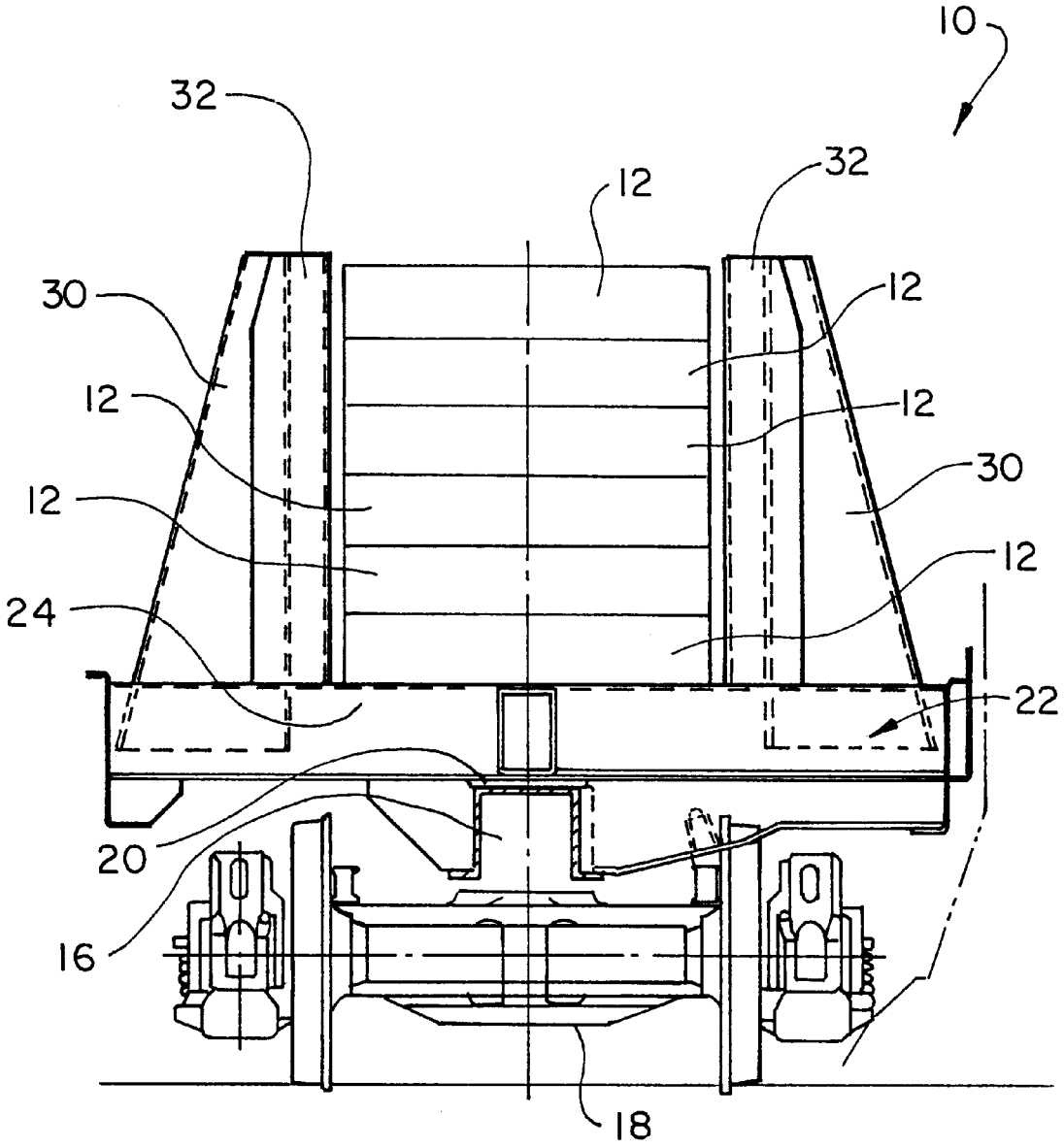
FIG. 3 is a sectional view of the railcar of FIG. 1 taken along section lines A—A and B—B of FIG. 2.

A railcar 10 according to the present invention is shown in FIGS. 1–8 with the railcar 10 being a 100–125 ton capacity steel flat car for hauling steel slabs 12 as shown in FIGS. 1–4 and the capacity for hauling steel coils 14 as shown in FIGS. 5–8. The railcar 10 design allows steel slabs 12 of various sizes and weights to be hauled efficiently by placing the slabs 12 longitudinally on the railcar 10 as shown in FIGS. 1–4.

The railcar 10 includes an underframe having a conventional center sill 16 supported on a conventional pair of spaced trucks 18 through bolsters 20. Above each truck 18 is a raised platform 22. The raised platform 22 includes a slab supporting frame member 24, an outer frame member 26, and plates extending at an angle from the frame members 24 and 26 to form a trough 28 above the bolster 20. As shown in FIGS. 1–4, the slabs 12 are supported on the frame members 24.

Figure 4:
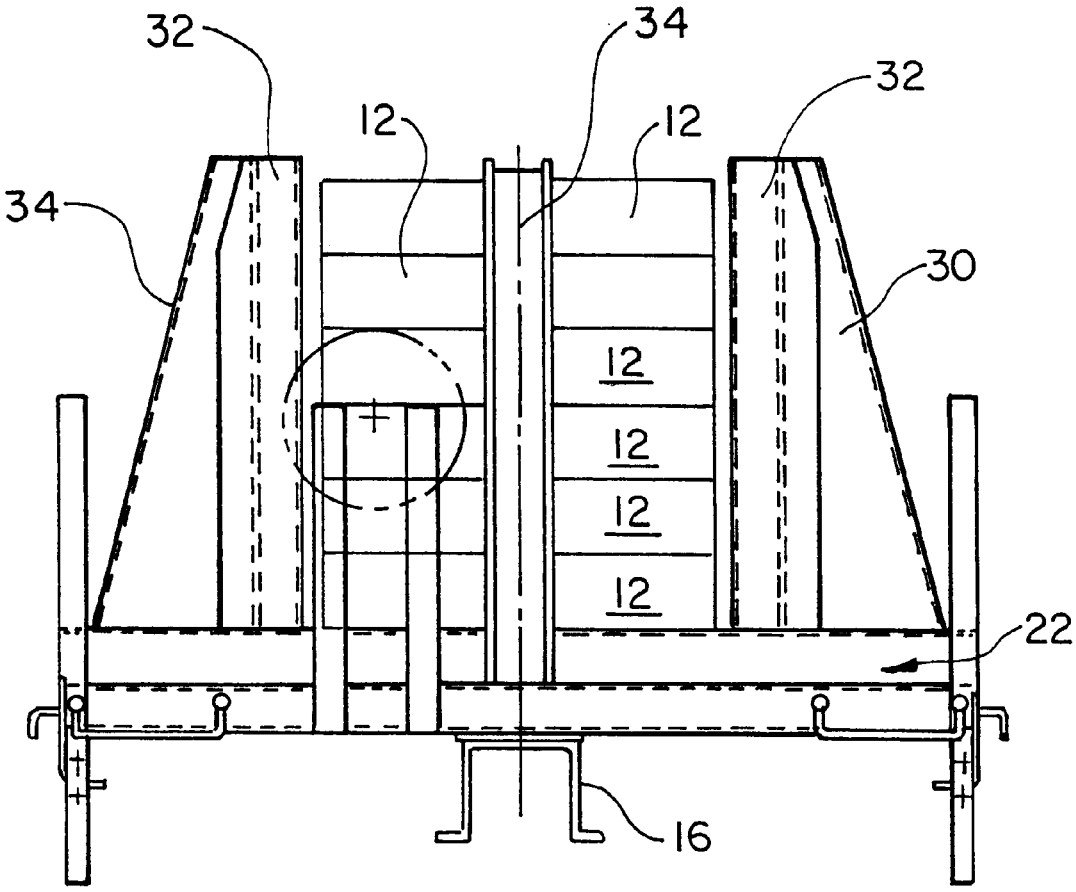
FIG. 4 is an end view of the railcar of FIG. 1.
Figure 5:
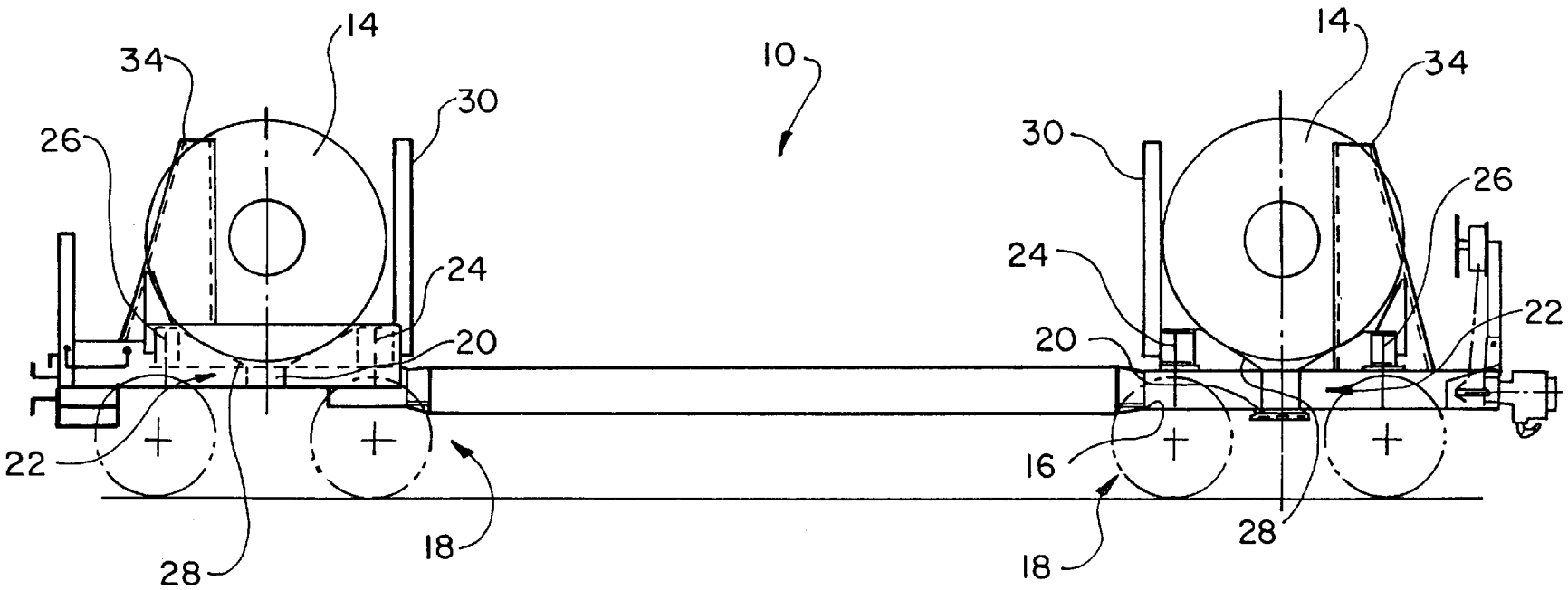
FIG. 5 is a side elevational view of the railcar of FIG. 1 loaded with steel coil.

The slabs 12 are captive by side stanchions 30 restricting the slabs from lateral movement. The side stanchions 30 are attached to the platform 22 and include slab restraints 32 moveable to accommodate differing widths of slabs 12 as best shown in FIG. 4. The railcar 10 includes end bulkheads 34 at the longitudinal ends of the railcar 10 preventing longitudinal movement of the slabs 12. The weight of the slabs 12 is concentrated near the bolsters 20 through raised mounting platforms 22.

Figure 6:
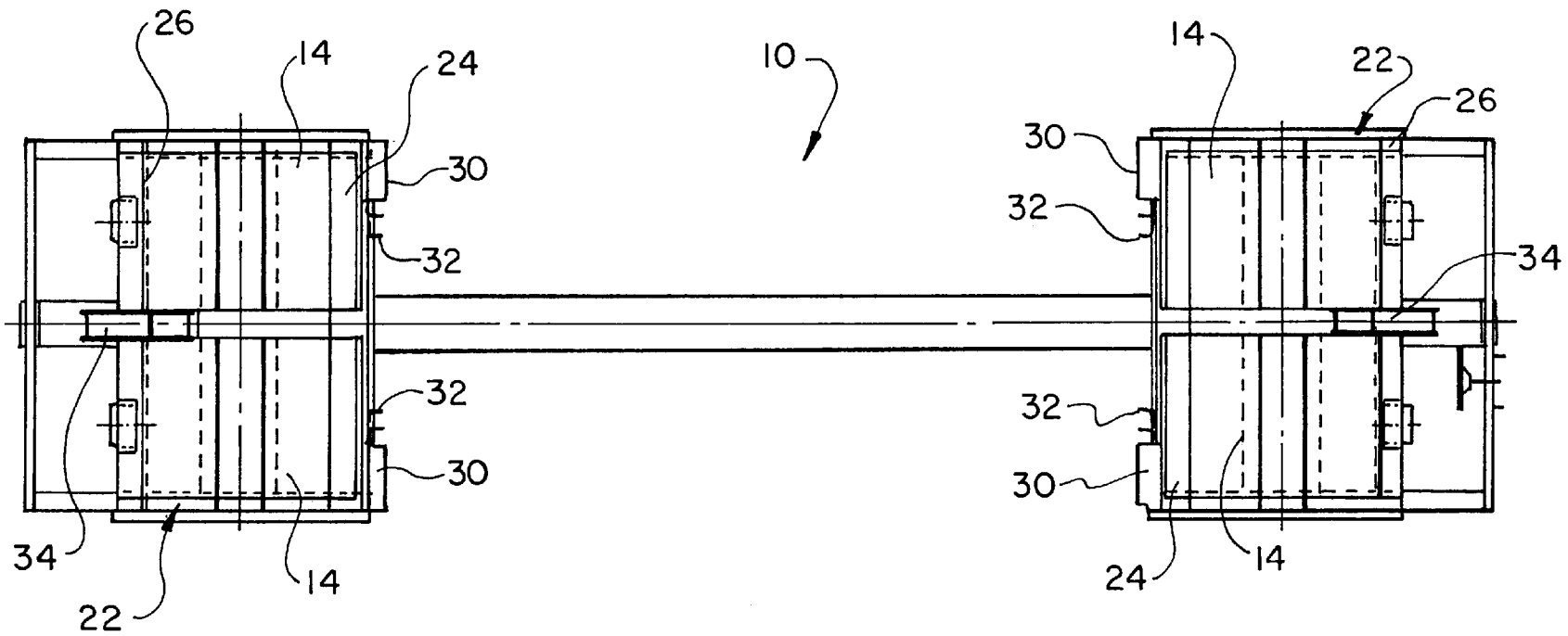
FIG. 6 is a plan view of the railcar of FIG. 5.
Figure 7:
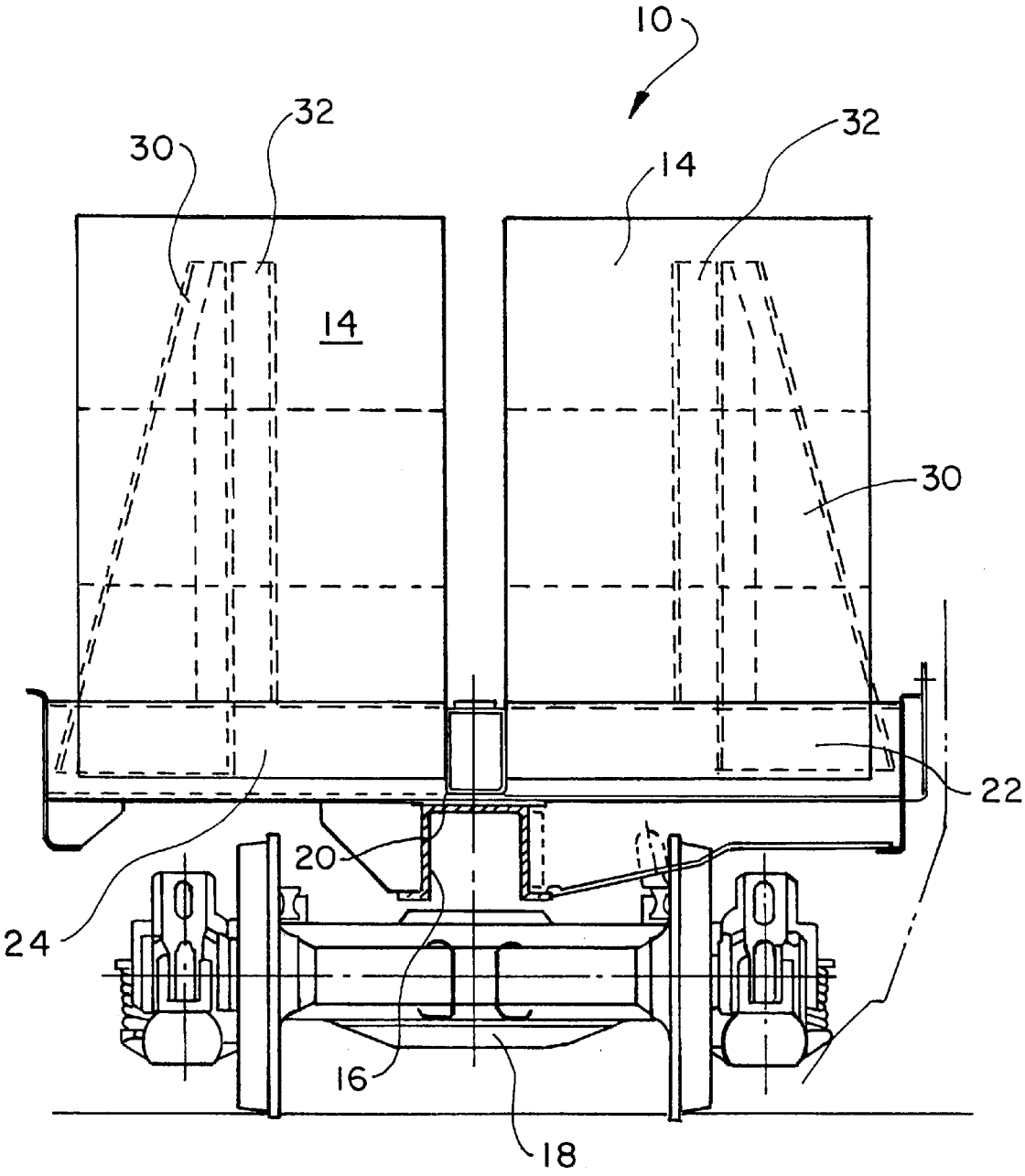
FIG. 7 is a sectional view of the railcar of FIG. 5 taken along section lines A—A and B—B of FIG. 6.
Figure 8:
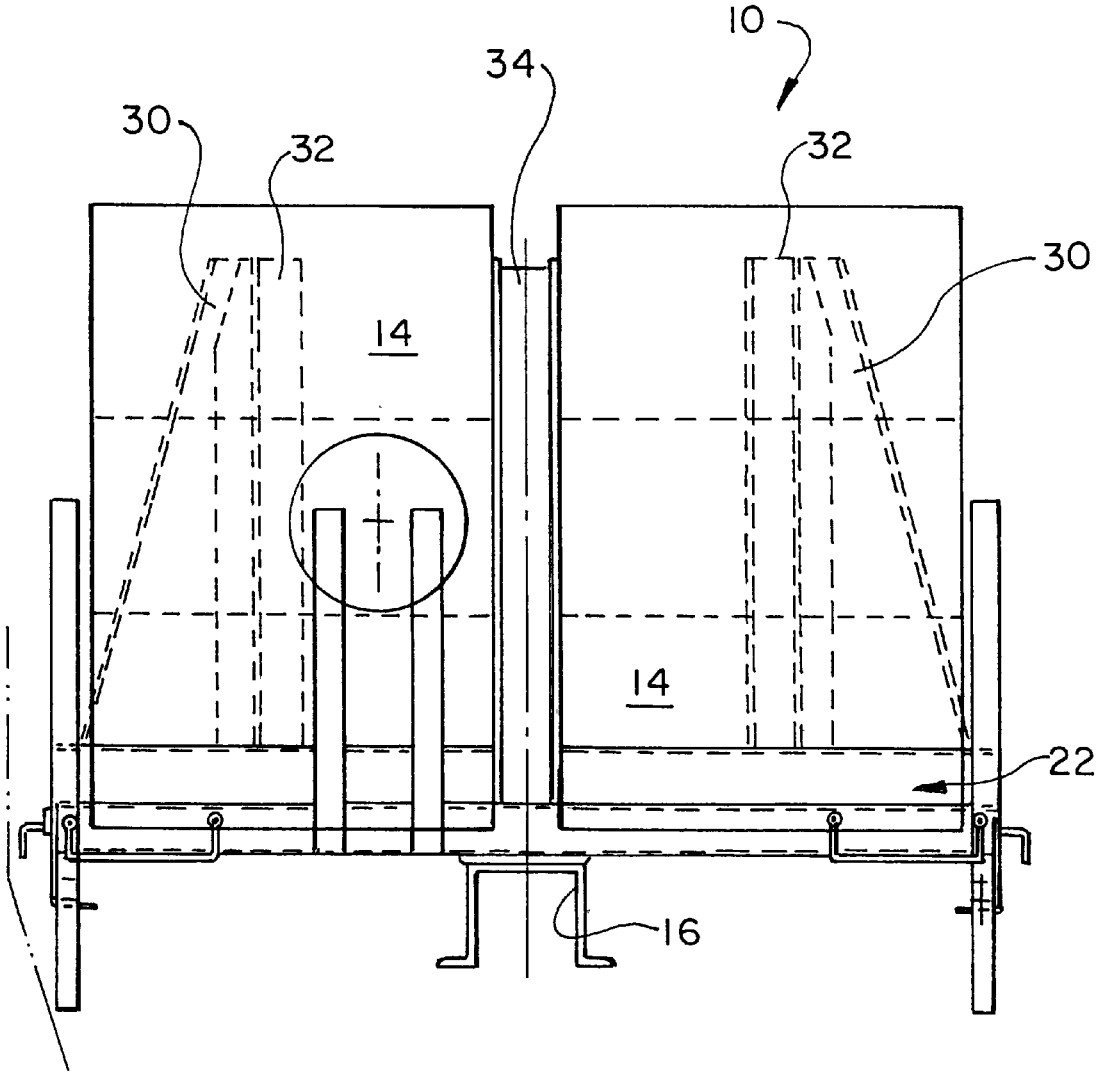
FIG. 8 is an end view of the railcar of FIG. 5.
Figure 10:
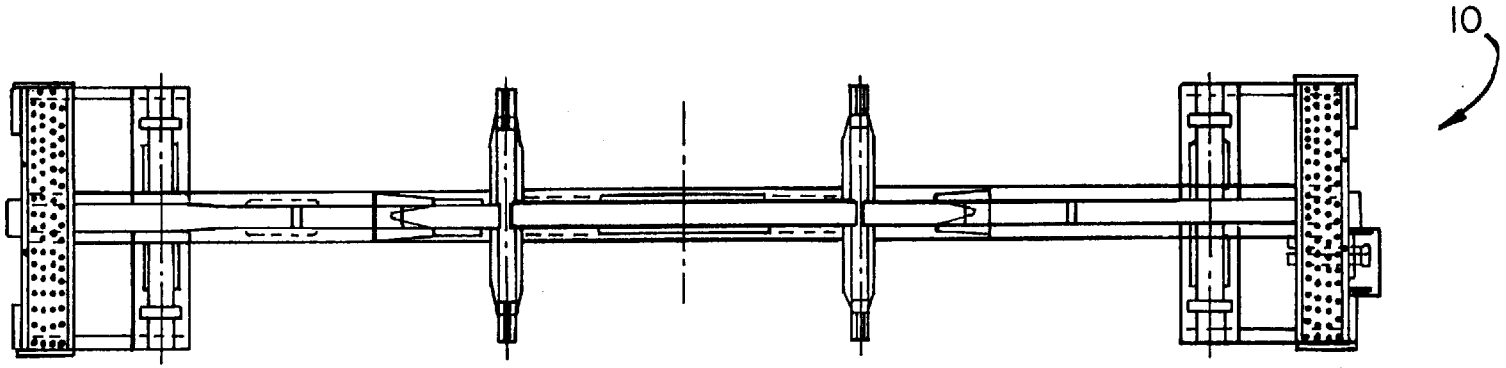
FIG. 10 is a plan view of the railcar of FIG. 9.
Figure 9:
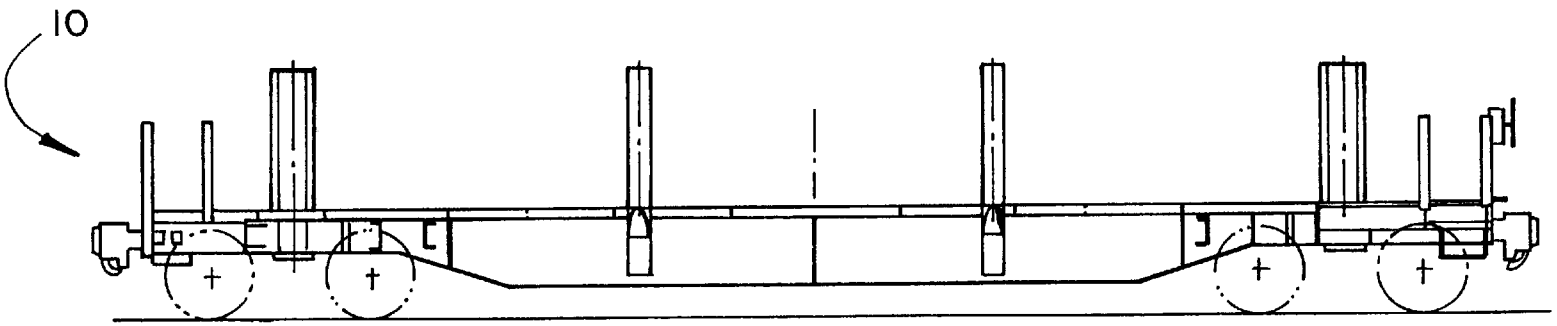
FIG. 9 is a side elevational view of a steel slab railcar according to another embodiment of the present invention.
Figure 11:
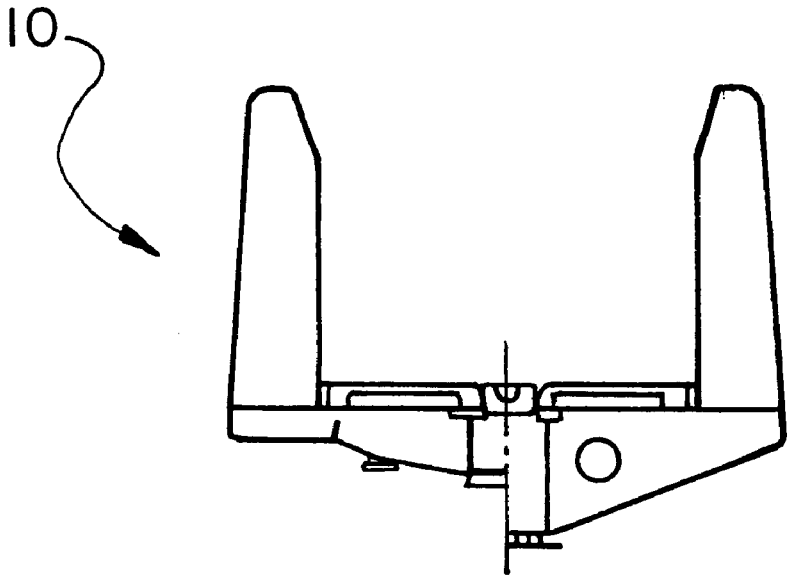
FIG. 11 is a sectional view of the railcar of FIG. 9 taken along a bolster and center stanchion, respectively.
Figure 12:
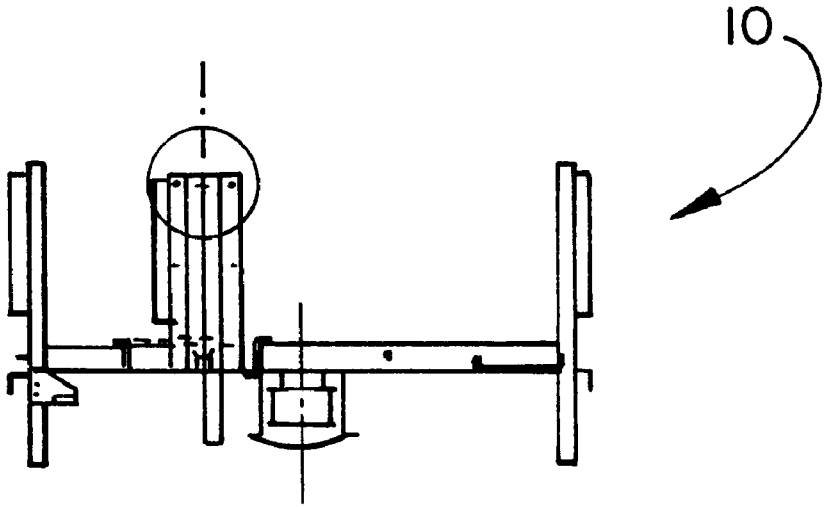
FIG. 12 is an end view of the railcar of FIG. 9.

The railcar 10 also has the capability to haul steel coils 14 in the trough 28 over the bolster 20 as shown in FIGS. 5–8. The end bulkheads 34 restrict and position the steel coils 14 as best shown in FIGS. 6 and 8 allowing the coils 14 in each trough 28 to have an 8" gap between them for ease of loading and unloading. One end of the railcar 10 has a built-in cross over platform. The slab side stanchions 30 double as steel coil stanchions restricting the steel coils from unwanted unloading due to coupler forces as shown in FIGS. 5–8.

The railcar 10 of the present invention provides increased hauling capacity for slabs 12 over prior art slab cars with less lineal track space. The loading and unloading of the railcar 10 is improved over the prior art slab railcars. The ability to alternatively carry steel coils 14 increases the flexibility of the railcar 10. Finally, the railcar 10 can be easily arranged to specifically suit a specific size of steel slab 12 as well as the diameter and width of steel coil 14.

A further slab car according to the present invention is shown in FIGS. 9–12 and is a 100 ton flat railcar designed to haul steel slabs. The railcar is designed for 286,000 pound gross rail load. The railcar can accommodate steel slabs between 35" to 72" in width and lengths up to 44'. The details of the railcars shown in FIGS. 1–12 were previously described in U.S. Provisional Patent Application Serial No. 60/260,443, filed Jan. 9, 2001 entitled "Slab and Coil Railcar", which is incorporated herein by reference.

It will be apparent to those of ordinary skill in the art that many changes may be made to the present invention without departing from the spirit and scope thereof. The scope of the present invention is not intended to be restricted by the specific embodiments described. The detailed embodiments are intended to be illustrative and not restrictive of the present invention.

We claim:

1. A railcar adapted to alternately haul slabs or coils, the railcar comprising:

an underframe having a conventional centersill;

the underframe supported on a pair of spaced trucks through bolsters;

a raised platform above each truck, each raised platform includes a slab supporting frame member and a trough above the bolster, wherein the slabs hauled by the railcar are supported on the frame members and the coils hauled by the railcar are supported in the trough.

2. The railcar of claim 1 further including side stanchions attached to each platform, wherein the side stanchions restrict the slabs hauled in the railcar from lateral movement.

3. The railcar of claim 2 wherein the side stanchions include slab restraints moveable to accommodate differing widths of slabs.

4. The railcar of claim 2 wherein the side stanchions restrict the coils hauled by the railcar from unwanted unloading due to coupler forces.

5. The railcar of claim 1 further including end bulkheads at the longitudinal ends of the railcar preventing longitudinal movement of the slabs.

6. The railcar of claim 5 wherein the end bulkheads restrict and position the coils hauled by the railcar allowing the coils in each trough to have a gap between them for ease of loading and unloading.

7. A flat railcar for selectively hauling steel slabs and steel coils, the railcar comprising:

a pair of spaced trucks;

a bolster supported on each trucks;

a center sill extending between the bolsters; and a raised platform supported on the bolster, the platform having a trough formed therein extending perpendicular to the center sill, wherein steel slabs carried by the railcar extend between and are supported by the platform and steel coils carried by the railcar are supported in one respective trough.

8. The flat car of claim 7 further including end bulkheads at longitudinal ends of the railcar preventing longitudinal movement of the steel slabs.

9. The flat car of claim 8 further including side stanchions on each platform restricting the slabs from lateral movement.

10. The flat car of claim 8 further including a space between bulkheads for loading and unloading of the load.

* * * * *

UNITED STATES PATENT AND TRADEMARK OFFICE

CERTIFICATE OF CORRECTION

PATENT NO. : 6,679,187 B2
DATED : January 20, 2004
INVENTOR(S) : Robert H. Dorian, Todd L. Lydic It is certified that error appears in the above-identified patent and that said Letters Patent is hereby corrected as shown below:

Column 4,
Lines 21-65, should read --

1. A railcar adapted to alternately haul slabs or coils, the railcar comprising:
an underframe having a conventional centersill;
a pair of spaced trucks and a pair of bolsters, the underframe supported on the pair of spaced trucks through the pair of bolsters, wherein each truck is supported on one of the bolsters;
a raised platform above each truck, each raised platform includes a fixed slab supporting frame member and a fixed trough above the bolster and the fixed trough extending from the fixed slab supporting frame member, wherein when the slabs are hauled by the railcar the slabs are supported on the fixed slab supporting frame members and when the coils are hauled by the railcar the coils are supported in the fixed trough, wherein the fixed slab supporting frame member and the fixed trough are fixed and stationary relative to the raised platform and the underframe.

2. The railcar of claim 1 further including vertically extending side stanchions attached to each platform adjacent the fixed slab supporting frame member, wherein the vertically extending side stanchions are adjacent the sides of the slabs to restrict the slabs hauled in the railcar from lateral movement.

3. The railcar of claim 2 wherein the vertically extending side stanchions include slab restraints moveable to accommodate differing widths of slabs.

4. The railcar of claim 2 wherein the vertically extending side stanchions are fixed in a position to also restrict the coils hauled by the railcar from unwanted unloading due to coupler forces.

5. The railcar of claim 1 further including fixed, vertically extending end bulkheads extending into the troughs at the longitudinal ends of the railcar preventing longitudinal movement of the slabs.

6. The railcar of claim 5 wherein the fixed end bulkheads extend between coils hauled by the railcar to restrict and position the coils hauled by the railcar allowing the coils in each trough to have a gap between them for ease of loading and unloading.

7. A flat railcar for selectively hauling steel slabs and steel coils, the railcar comprising:
a pair of spaced trucks;
a bolster supported on each trucks;
a center sill extending between the bolsters; and
a fixed raised platform supported on each of the bolsters, the fixed platform having a fixed trough formed therein extending perpendicular to the center sill, wherein the platform and the trough are fixed relative to the center sill and the bolsters, and wherein the steel slabs carried by the railcar extend between and are supported by the fixed platforms and the steel coils carried by the railcar are supported in the fixed troughs.

8. The flat car of claim 7 further including fixed, vertically extending end bulkheads at longitudinal ends of the railcar extending partially into the throughs and preventing longitudinal movement of the steel slabs.

9. The flat car of claim 8 further including vertically extending side stanchions on each platform restricting the slabs from lateral movement.

10. The flat car of claim 8 further including a space between the fixed end bulkheads for loading and unloading of the load. - -

Signed and Sealed this

Eighth Day of June, 2004

JON W. DUDAS
*Acting Director of the United States Patent and Trademark Office*